United States Patent [19]

Ito et al.

[11] 4,206,326

[45] Jun. 3, 1980

[54] ROTARY SWITCH

[75] Inventors: Katsuo Ito; Kazunori Yoshimura; Kazuo Kontani; Bunjiro Murata, all of Kanazawa, Japan

[73] Assignee: Murata Manufacturing Co., Ltd., Kyoto, Japan

[21] Appl. No.: 907,849

[22] Filed: May 19, 1978

[30] Foreign Application Priority Data

Jun. 13, 1977 [JP] Japan ..... 52-77707[U]

[51] Int. Cl.[2] ..... H01H 19/02

[52] U.S. Cl. ..... 200/11 R; 200/14; 200/293

[58] Field of Search ..... 200/11 D, 11 DA, 14, 200/15, 293, 294, 295, 296, 11 R; 334/1, 85, 89

[56] References Cited

U.S. PATENT DOCUMENTS

| | | | |
|---|---|---|---|
| 2,787,713 | 4/1957 | Aust et al. | 200/11 DA X |
| 2,789,212 | 4/1957 | Achenbach et al. | 200/11 D X |
| 2,801,377 | 7/1957 | Selbmann et al. | 200/14 X |
| 2,817,723 | 12/1957 | Allison | 200/14 |
| 2,920,197 | 1/1960 | Frihart | 334/85 X |
| 2,976,375 | 3/1961 | Valdettaro | 200/14 |
| 3,091,679 | 5/1963 | Norden | 200/295 |
| 3,093,713 | 6/1963 | Eadie | 200/14 |
| 3,210,485 | 10/1965 | Ma | 200/11 D |

*Primary Examiner*—James R. Scott
*Attorney, Agent, or Firm*—Wenderoth, Lind & Ponack

[57] ABSTRACT

The present invention relates to a rotary switch which is an improved stator provided with a plurality of projections extending outwardly from its edges to confront the corresponding surfaces of an improved chassis or the like to which the stator is to be secured. The improved chassis is formed, in positions corresponding to the positions of the projections of the stator, with openings or cutout portions each having a claw which can be deformed or bent. By bending the claws toward the projections after inserting the projections into the openings in the chassis, the projections of the stator are firmly held between the chassis and the claws and rigidly secure the stator to the chassis.

4 Claims, 6 Drawing Figures

ROTARY SWITCH

BACKGROUND OF THE INVENTION

The present invention relates to an electrical switch and more particularly, to a rotary switch having an improved arrangement for simply and positively securing its stator to a chassis of electrical and electronic equipment.

Commonly, a rotary switch, for example, one employed in a tuner of a television receiver for selecting local oscillation coils in a local oscillation circuit according to channels includes, as shown in FIG. 1, a rotor 1 mounted on a rotary shaft (not shown) and having a plurality of local oscillation coils 2a, 2b, 2c . . . and 2n provided on its peripheral edge in spaced relation from each other, corresponding to the channels to be received, contact pieces 3a, 3b, 3c . . . and 3n radially outwardly extending from the peripheral edge of the rotor 1 and electrically connected to the corresponding local oscillation coils 2a, 2b, 2c . . . and 2n, and a stator 5 of plate-like configuration secured to a chassis 4 or frame of the tuner in a known manner as described later and provided, at its side edge confronting the rotor 1, with contact piece clips 7a and 7b which are secured thereat, for example, by eyelets 6a and 6b and which have contacts 8a and 8b at the distal ends thereof in the rotating locus of the contact pieces 3a, 3b, 3c . . . and 3n, so that the desired local oscillation coils 2a, 2b, 2c . . . and 2n are selectively connected to the contact piece clips 7a and 7b during rotation of the rotary shaft.

In the conventional rotary switch as described above, the stator 5 is provided, for example, with a fixing member 5a secured in a position adjacent to its side edge corresponding to the chassis 4 so that the fixing member 5a can be connected to the chassis 4 either by a screw 9a, a nut 9b and a spring washer 9c or by an eyelet (not shown), thereby securing the stator 5 to the chassis 4.

However, the known arrangement as described above in which the stator 5 is secured to the chassis 4 by the screw or eyelet has a disadvantage in that since the screw 9a, nut 9b, and washer 9c or eyelet are required, the increase in the number of parts involved not only gives rise to an increase in man-hours during manufacturing, but also results in a high cost rotary switch.

SUMMARY OF THE INVENTION

Accordingly, an essential object of the present invention is to provide a rotary switch which is provided with an improved arrangement for readily and positively securing its stator to a chassis of electrical and electronic equipment, with substantial elimination the disadvantages inherent in the conventional rotary switches of the kind.

Another important object of the present invention is to provide a rotary switch of the above described type which requires no separate parts such as screws, nuts, washers or eyelet, etc. for securing its stator to a chassis and the like, thereby reducing the costs and the man-hours required to manufacture the rotary switch.

A further object of the present invention is to provide a rotary switch of the above described type which is simple in construction and stable in functioning without any loosening of the stator even after the rotary switch has been used for a long period of time.

In accomplishing these and other objects, according to a preferred embodiment of the present invention, the rotary switch includes a stator which is provided with a plurality of projections extending outwardly from the edges thereof on the sides confronting the corresponding surfaces of a chassis or the like to which the stator is to be secured. The chassis is formed, in positions corresponding to those of the projections of the stator with openings or cutout portions of which has a claw that can be deformed or bent. By subjecting the claws to manual plastic deformation after inserting the projections into said openings in the chassis, the projections of the stator are firmly held between the chassis and the claws, thus securing the stator to the chassis. In this manner, parts such as screws, nuts, washers or eyelet, etc. conventionally required for connecting the stator and chassis are advantageously dispensed with. Consequently there is a reduction in man-hours required for assembly, thus further reducing the cost of the rotary switch itself.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout the several views of the accompanying drawings.

DETAILED DESCRIPTION OF THE INVENTION

Figure 1:
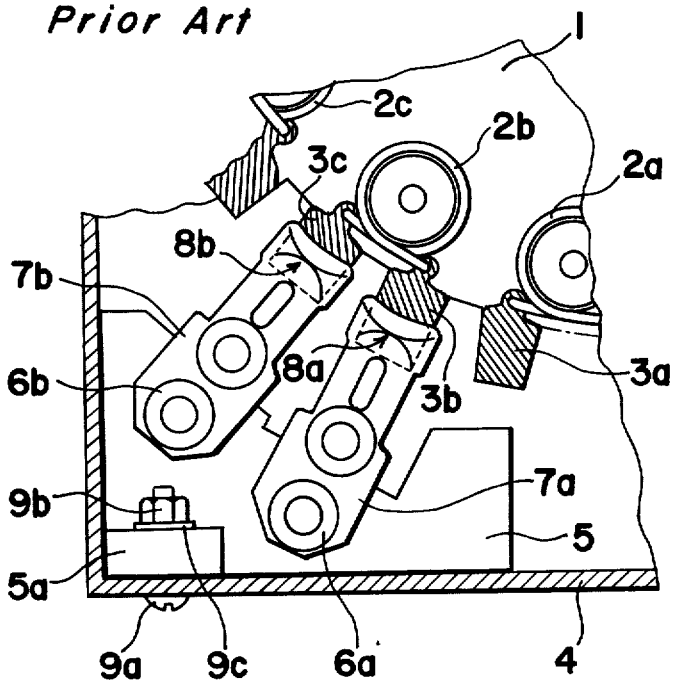
Fig. 1 Prior Art
FIG. 1 is a fragmentary top plan view partially in section and, as already referred to, showing a conventional arrangement for securing a stator of a rotary switch to a chassis.
Figure 2:
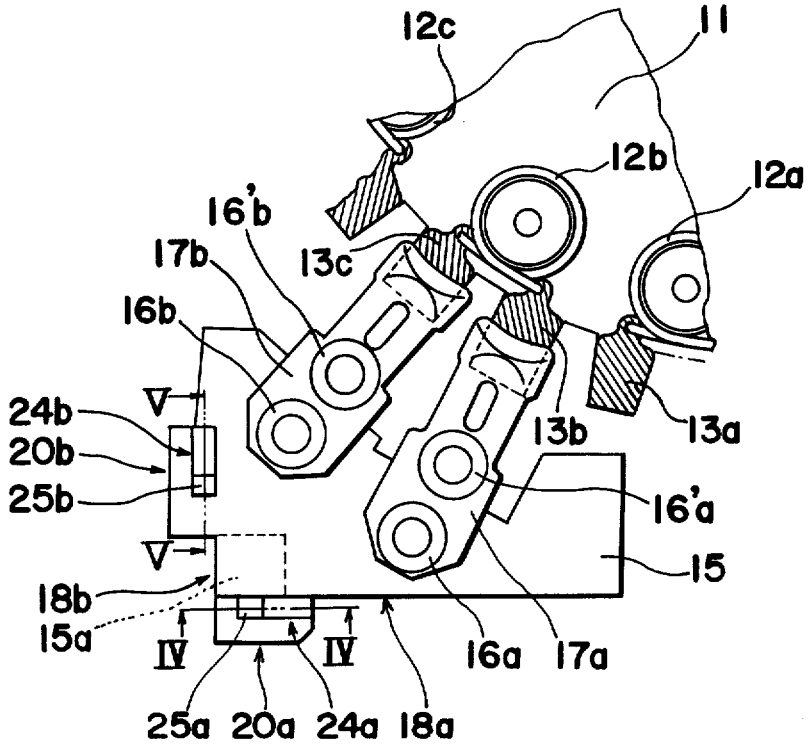
FIG. 2 is a similar view to FIG. 1, but particularly shows an improved arrangement for securing a stator of a rotary switch to a chassis according to one preferred embodiment of the present invention, the chassis being removed for clarity.

Referring now to the drawings, in FIG. 2 one preferred embodiment of the present invention is shown as it is applied to the selection of local oscillation coils of a tuner for a television receiver. The rotary switch includes a rotor 11 secured to a rotary shaft (not shown) for simultaneous rotation therewith and has a plurality of local oscillation coils 12a, 12b, 12c . . . and 12n on its peripheral edge in a spaced relation from each other to correspond to the channels to be received. Contact pieces 13a, 13b, 13c . . . and 13n extend radially outwardly from the peripheral edge of the rotor 11 and are electrically connected to the corresponding local oscillation coils 12a, 12b, 12c . . . and 12n respectively. A stator 15 made of insulating material is fixed to a chassis 19 (FIG. 3) in a manner as will be described in detail later, and contact piece clips 17a, 17b, each comprising a pair of resilient metal pieces, are secured, for example, by eyelets 16a and 16b to the side edge of the stator 15 confronting the rotor 11. The pair of metal pieces for the contact piece clips 17a and 17b are further fixed by eyelets 16'a and 16'b as shown. It should be noted here that the construction of the rotary switch in FIG. 2 described so far is similar to that in the conventional rotary switch of FIG. 1, except for the novel arrangement for securing the stator 15 to the chassis 19 directly related to the present invention and to be described in greater detail hereinbelow.

Figure 6:
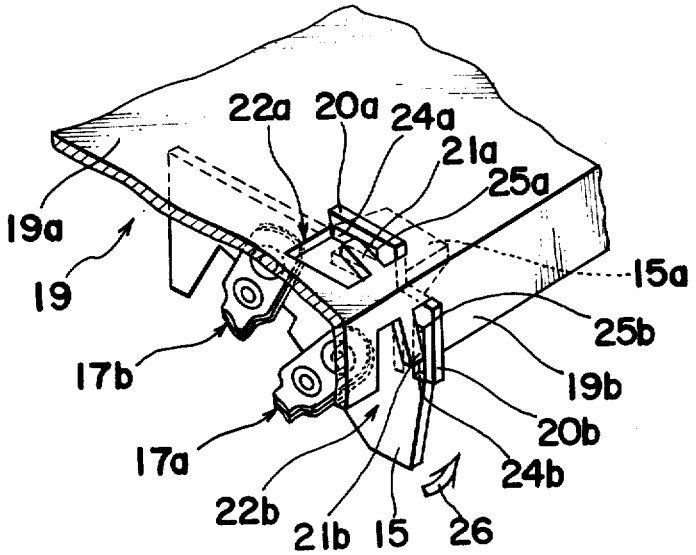
FIG. 6 is a fragmentary perspective view showing the state in which the stator of the rotary switch according to the present invention is secured to the chassis of FIG. 3.

The stator 15 formed from insulating resinous material, for example, epoxy resin, phenol resin, etc. into an approximately triangular configuration has side edges 18a and 18b remote from the edge thereof where the contact piece clips 17a and 17b are secured. The chassis 19 (of deformable metallic material) includes a base portion 19a and a sidewall portion 19b extending at right angles from the base portion 19a as shown in FIG. 3, and when the stator 15 is secured to the chassis 19 in a direction perpendicular to the base portion 19a and the sidewall portion 19b of the chassis 19, the edges 18a and 18b of the stator 15 closely contact the inner surfaces of the portions 19a and 19b (FIG. 6).

On the edge 18a of the stator 15 in a position adjacent a corner formed by the intersection of the two edges 18a and 18b, a projection 20a of approximately rectangular configuration having a thickness larger than that of the chassis 19 projects outwardly in a direction normal to the base portion 19a. On the other edge 18b in a position slightly spaced from the corner, there is also provided another approximately rectangular projection 20b having a thickness larger than that of the chassis 19 which also projects outwardly in a direction normal to the side wall portion 19b of the chassis 19 when the stator 15 is to be fixed to the chassis 19.

Figure 3:
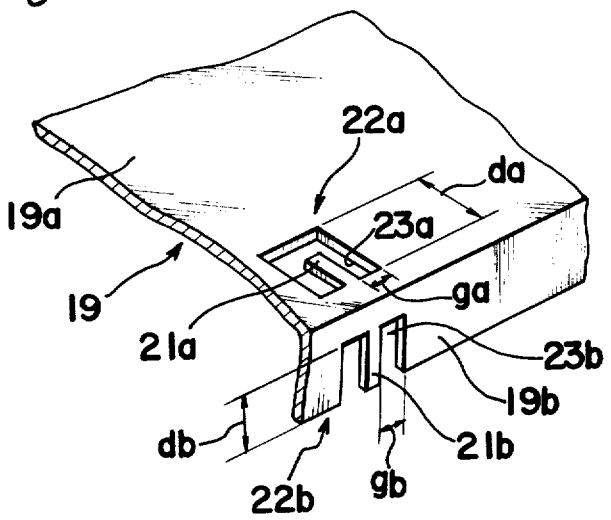
FIG. 3 is a fragmentary perspective view of a chassis to which the rotary switch according to the present invention may be secured.

Referring particularly to FIG. 3, in the base portion 19a, and side wall portion 19b of the chassis 19 at positions corresponding to the projections 18a and 18b of the stator 15, are an approximately square opening 22a and a cutout portion 22b, which are respectively provided, at the central portions thereof, with claws 21a and 21b extending from the chassis 19. It should be noted that the width ga of the clearance 23a defined between one side of the claw 21a and the corresponding edge of the opening 22a, and the length da of the clearance 23a are respectively made slightly larger than the thickness and length of the projection 20a of the stator 15, so that the projection can be inserted into the clearance 23a. The claw 21a has a length sufficient for connecting the projection 20a and a width enough to maintain ample strength even after deformation of the claw 21a. In a manner similar to that described above, the width gb of the clearance 23b between one side of the claw 21b and a corresponding edge of the cutout portion 22b and the length db of the clearance 23b are respectively made sufficiently large to receive the projection 20b of the stator 15, the claw 21b being provided with ample dimensions to permit the claw 21b to fully contact the projection 20b with sufficient strength even after deformation.

Figure 4:
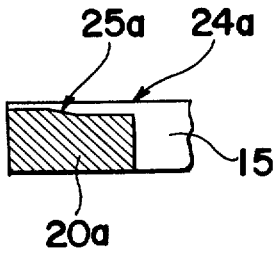
FIG. 4 is a cross sectional view taken along the line IV—IV of FIG. 2.
Figure 5:
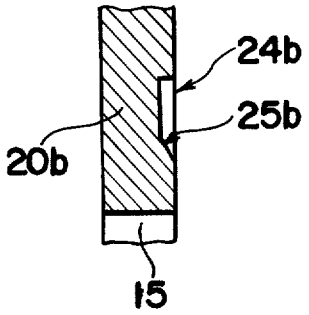
FIG. 5 is a cross sectional view taken along the line V—V of FIG. 2.

For rigid connection between the stator 15 and the chassis 19, it is preferable that the projections 20a and 20b be respectively provided with recesses or grooves 24a and 24b (FIG. 2) formed therein in directions parallel to the edges 18a and 18b and have widths slightly larger than the thickness of the chassis 19 for receiving the claws 21a and 21b in the grooves 24a and 24b. It is also preferable that these grooves 24a and 24b be respectively provided at the bottom portions thereof with tapered portions 25a and 25b directed in the directions of the claws 21a and 21b when the claws are bent toward the projections 20a and 20b, as most clearly seen in FIGS. 4 and 5, so that upon deformation or bending of the claws 21a and 21b toward the corresponding projections 20a and 20b, the side edges of the claws 21a and 21b will contact the grooves 24a and 24b of the projections 20a and 20b over the entire lengths of the latter, thereby preventing formation of cracks in the stator 15 due to local force applied thereto.

According to the above arrangement, to secure the stator 15 to the chassis 19, the projections 20a and 20b of the stator 15 are respectively inserted into the clearances 23a and 23b of the chassis 19, and subsequently, the claws 21a and 21b are forcfully subjected to plastic deformation or bending by suitable means such as a screw driver (not shown), from positions shown by dotted lines to positions indicated by solid lines in FIG. 6. In this way, the distal ends of the claws 21a and 21b fit into the grooves 24a and 24b of the projections 20a and 20b with the claws 21a and 21b depressing the tapered portions 25a and 25b of the grooves 24a and 24b, so that the stator 15 is firmly secured to the chassis 19 with the projections 20a and 20b of the stator 15 held between the edges of the claws 21a and 21b and corresponding edges of the opening 22a and cutout portion 22b respectively.

As is seen from the foregoing description, according to the arrangement of the present invention, the stator 15 can be readily fixed to the chassis 19 without using separate parts such as screws, nuts or eyelets and the like, since the securing position of the stator 15 is defined by the grooves 24a and 24b of the projections 20a and 20b. With the tapered portions 25a and 25b of the grooves 24a and 24b being approximately uniformly depressed by the claws 21a and 21b, the stator 15 is rigidly secured to the chassis 19 with high accuracy.

In the arrangement of the present invention as described above, to prevent the stator 15 from inclining in the direction of arrow 26 in FIG. 6, i.e., in the direction in which the claw 21b is bent, it is preferable that the stator 15 be further provided with a protrusion 15a (FIGS. 2 and 6) of trapezoidal cross section extending outwardly from the stator 15 in such a manner that, after the stator 15 is fixed to the chassis 19, one surface of the protrusion 15a contacts the corresponding surface of the base portion 19a of the chassis 19 to ensure that the stator 15 is secured to the chassis 19 in a direction normal to the portions 19a and 19b of the latter without any inclination.

It should be noted here that the grooves 24a and 24b in the projections 20a and 20b in the foregoing embodiment may be dispensed with or modified in their configuration from the rectangular shape, for example, to recesses of various other shapes, and the projections 20a and 20b, corresponding opening 22a and cutout portion 22b, and claws 21a and 21b may also be modified within the scope of this invention in their number and shapes so long as the stator 15 is firmly secured to the chassis 19.

It should also be noted that, although the present invention is mainly described with reference to the rotary switch for the selection of the local oscillation coils in the foregoing embodiment, the concept of the present invention is not limited in its application to such a rotary switch for local oscillation coil selection alone, but may readily be applicable to various other rotary switches for different purposes.

As is clear from the foregoing description, in the rotary switch according to the present invention, since it is arranged so that the stator is rigidly secured to the chassis with high accuracy by deforming or bending the claws provided in the openings or cutout portions in the chassis toward the projections of the stator for holding such projections of the stator between the claws and the chassis, the various effects which follow can advantageously be achieved:

(i) The stator can positively and readily be secured to the chassis through mere deformation of the claws by suitable means, for example, by using a screw driver and the like, without employing separate fixing parts such as screws, nuts, eyelets, etc., thereby simplifying the manufacturing process and reducing the number of parts and total cost.

(ii) By providing the grooves or recesses in the projections of the stator, the securing position of the stator is defined by these grooves or recesses, and thus, the stator can be fixed to the chassis with high accuracy.

(iii) Since the grooves or recesses as described above are further provided with the tapered portions for permitting the claws to approximately, uniformly depress the projections, the contact area between the claws and stator is increased for rigid connection of the additional stator to the chassis.

(iv) By further providing the protrusion on the stator, any inclination of the stator after being secured to the chassis is advantageously prevented because the protrusion contacts the corresponding surface of the chassis.

Although the present invention has been fully described by way of examples with reference to the accompanying drawings, it is to be noted that various changes and modifications will be apparent to those skilled in the art. Therefore, unless such changes and modifications otherwise depart from the scope of the present invention, they should be construed as included therein.

What is claimed is:

1. In a rotary switch for a television tuner which has:

a rotary shaft, a rotor on said shaft rotatable with said shaft, a plurality of contact pieces extending radially outwardly from the peripheral edge of said rotor, a chassis spaced from said rotor and having at least two sides joined together at a right angle, a plate-like stator having the edges thereof positioned between said sides of said chassis opposite said rotor, and a plurality of contact piece clips at the edge of said stator opposite said rotor, said contact pieces being selectively engagable with said contact pieces on said rotor when said rotatable shaft is rotated, an improvement for securing said stator to said chassis, said improvement comprising:

an improved stator having a projection along each edge thereof adjacent said chassis, each projection having a recess therein; and an improved chassis having a plurality of openings therethrough, one in each side thereof, for receiving said projections of said improved stator, at least one of said openings being a hole cut through one of said sides and at least one of said openings being cut from an edge of one of said sides, said improved chassis further having a deformable claw member in each of said openings, whereby inserting said projections through said openings and deforming said claw members into said recesses in said projections securely affixes said improved stator to said improved chassis.

2. An improved rotary switch as claimed in claim 1, wherein said stator is further provided with a protrusion extending therefrom transverse to the direction of said projection for contacting the under surface of one side of said chassis when said projection is inserted through said opening, whereby said protrusion prevents said stator from inclining away from said chassis when said rotatable shaft is rotated.

3. An improved rotary switch as claimed in claim 1, wherein said recess is a groove longitudinally formed in said projection.

4. An improved rotary switch as claimed in claim 1, wherein said recess of said projection is further provided therein with a tapered portion directed in a direction of the claw member after the deformation of said claw member toward said projection.

* * * * *